US008555420B2

(12) United States Patent
Duclos

(10) Patent No.: US 8,555,420 B2
(45) **Date of Patent: *Oct. 15, 2013**

(54) COMBINATION SOCK AND SHOE

(75) Inventor: Gary Paul Duclos, Newburyport, MA (US)

(73) Assignee: Converse Inc., North Andover, MA (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/250,136

(22) Filed: Sep. 30, 2011

(65) Prior Publication Data

US 2012/0017355 A1 Jan. 26, 2012

Related U.S. Application Data

(63) Continuation of application No. 11/961,245, filed on Dec. 20, 2007, now Pat. No. 8,056,149.

(51) Int. Cl.

| | |
|---|---|
| ***A43B 23/02*** | (2006.01) |
| ***A43B 17/00*** | (2006.01) |
| ***A43B 1/00*** | (2006.01) |

(52) U.S. Cl.

USPC ..... 2/239; 36/102; 36/109

(58) Field of Classification Search

USPC ..... 2/239, 240; 36/55, 12, 114, 113, 10, 36/109, 102, 99, 1.5, 15, 9 R, 112, 138, 83, 36/2 R

See application file for complete search history.

(56) References Cited

U.S. PATENT DOCUMENTS

| | | | | | |
|---|---|---|---|---|---|
| 1,418,188 | A | * | 5/1922 | Jacobs | 36/85 |
| 1,472,415 | A | * | 10/1923 | Haggerty | 36/89 |
| 2,415,004 | A | * | 1/1947 | Feldhake | 36/102 |
| 2,538,673 | A | * | 1/1951 | Donahue | 36/9 R |
| 2,586,045 | A | * | 2/1952 | Hoza | 36/9 R |
| 2,659,911 | A | * | 11/1953 | Spack | 12/142 R |
| 2,679,117 | A | * | 5/1954 | Reed | 36/9 R |
| 3,035,291 | A | * | 5/1962 | Bingham, Jr. | 12/142 RS |
| 3,475,835 | A | * | 11/1969 | Kovar | 36/1.5 |
| 3,744,163 | A | * | 7/1973 | Simister | 36/97 |
| 3,863,272 | A | * | 2/1975 | Guille | 2/239 |
| 4,169,324 | A | * | 10/1979 | Gibbs | 36/83 |
| 4,276,671 | A | * | 7/1981 | Melton | 12/142 T |
| 4,317,292 | A | * | 3/1982 | Melton | 36/9 R |
| 4,538,368 | A | * | 9/1985 | Mugford | 36/112 |
| 4,599,810 | A | * | 7/1986 | Sacre | 36/55 |
| 4,713,895 | A | * | 12/1987 | Vallieres | 36/1.5 |
| 4,809,447 | A | * | 3/1989 | Pacanowsky et al. | 36/9 R |
| 4,845,862 | A | * | 7/1989 | Phillips et al. | 36/83 |
| 4,852,272 | A | * | 8/1989 | Chilewich et al. | 36/12 |
| 4,907,350 | A | * | 3/1990 | Chilewich et al. | 36/19 R |

(Continued)

*Primary Examiner* — Alissa L Hoey

(74) *Attorney, Agent, or Firm* — Shook, Hardy & Bacon L.L.P.

(57) ABSTRACT

A combination sock and shoe includes a shoe sole, an exterior sock that is secured to the shoe sole, an intermediate sock positioned inside the exterior sock, and an interior sock positioned inside the exterior sock and inside the intermediate sock. The intermediate sock is constructed as an anklet having an elastic ankle opening. The exterior and interior socks conceal the intermediate sock from view by sandwiching the intermediate sock between them. When a wearer's foot is inserted into the combination sock and shoe, the elastic ankle opening of the intermediate sock securely engages around the ankle of the wearer's foot and holds the wearer's foot to the shoe sole, thereby preventing the shoe sole from separating away from the heel of the wearer's foot during walking.

15 Claims, 4 Drawing Sheets

(56) References Cited

U.S. PATENT DOCUMENTS

| | | | | | |
|---|---|---|---|---|---|
| 4,926,568 | A * | 5/1990 | Coffman | 36/15 |
| 4,967,494 | A * | 11/1990 | Johnson | 36/9 R |
| 5,067,260 | A * | 11/1991 | Jenkins, Jr. | 36/7.1 R |
| 5,157,791 | A * | 10/1992 | Woodson et al. | 2/239 |
| 5,165,182 | A * | 11/1992 | Michael | 36/1.5 |
| 5,325,541 | A * | 7/1994 | Willard | 2/239 |
| 5,353,524 | A * | 10/1994 | Brier | 36/55 |
| 5,381,610 | A * | 1/1995 | Hanson | 36/100 |
| 5,553,399 | A * | 9/1996 | Strong | 36/9 R |
| 5,617,585 | A * | 4/1997 | Fons et al. | 2/239 |
| 5,774,898 | A * | 7/1998 | Malpee | 2/239 |
| 5,918,314 | A * | 7/1999 | Moses | 2/79 |
| 5,937,543 | A * | 8/1999 | Hall et al. | 36/10 |
| 6,047,434 | A * | 4/2000 | Falwell | 15/227 |
| 6,148,544 | A * | 11/2000 | Keen et al. | 36/1.5 |
| 6,308,438 | B1 * | 10/2001 | Throneburg et al. | 36/9 R |
| 6,662,377 | B2 * | 12/2003 | Williams | 2/239 |
| 6,665,883 | B2 * | 12/2003 | Sloan | 2/239 |
| 6,807,683 | B2 * | 10/2004 | Williams | 2/239 |
| 6,836,916 | B2 * | 1/2005 | Chen et al. | 12/142 A |
| 6,851,205 | B2 * | 2/2005 | Chen et al. | 36/55 |
| 6,880,268 | B2 * | 4/2005 | Chen | 36/43 |
| 7,159,335 | B2 * | 1/2007 | Chen | 36/4 |
| 7,370,438 | B2 * | 5/2008 | Vattes et al. | 36/10 |
| 7,434,336 | B2 * | 10/2008 | Kosted | 36/10 |
| 8,056,149 | B2 * | 11/2011 | Duclos | 2/239 |
| 2001/0037587 | A1 * | 11/2001 | Lu | 36/14 |
| 2001/0049886 | A1 * | 12/2001 | Chen | 36/12 |
| 2001/0049889 | A1 * | 12/2001 | Chen | 36/55 |
| 2002/0120977 | A1 * | 9/2002 | Smith | 2/242 |
| 2003/0093919 | A1 * | 5/2003 | Wang | 36/10 |
| 2004/0010938 | A1 * | 1/2004 | Li-Wang et al. | 36/9 R |
| 2004/0098880 | A1 * | 5/2004 | Chen et al. | 36/14 |
| 2004/0143996 | A1 * | 7/2004 | Chen et al. | 36/55 |
| 2004/0187352 | A1 * | 9/2004 | Chen et al. | 36/55 |
| 2004/0226076 | A1 * | 11/2004 | Chen | 2/239 |
| 2005/0066544 | A1 * | 3/2005 | Beak | 36/43 |
| 2005/0076541 | A1 * | 4/2005 | von Blucher | 36/113 |
| 2005/0102862 | A1 * | 5/2005 | Baychar | 36/55 |
| 2006/0026740 | A1 * | 2/2006 | Vargas et al. | 2/239 |
| 2006/0112591 | A1 * | 6/2006 | Lombardo | 36/7.5 |
| 2006/0117598 | A1 * | 6/2006 | Czaplewski et al. | 36/2 R |
| 2006/0137223 | A1 * | 6/2006 | Ziccarelli | 36/55 |
| 2006/0225186 | A1 * | 10/2006 | Davenport | 2/239 |
| 2007/0062067 | A1 * | 3/2007 | Covatch | 36/55 |
| 2007/0118974 | A1 * | 5/2007 | Hexels | 2/239 |
| 2007/0271819 | A1 * | 11/2007 | Chen | 36/43 |
| 2008/0005927 | A1 * | 1/2008 | Hung | 36/15 |
| 2008/0066347 | A1 * | 3/2008 | Suzuki | 36/83 |
| 2008/0282578 | A1 * | 11/2008 | von Blucher | 36/98 |
| 2009/0000012 | A1 * | 1/2009 | Hsieh | 2/240 |
| 2009/0019731 | A1 * | 1/2009 | Braynock et al. | 36/100 |
| 2009/0158503 | A1 * | 6/2009 | Duclos | 2/239 |

* cited by examiner

COMBINATION SOCK AND SHOE

CROSS-REFERENCE TO RELATED APPLICATIONS

This application is a Continuation of U.S. patent application Ser. No. 11/961,245, filed Dec. 20, 2007, entitled "Combination Sock and Shoe," now U.S. Pat. No. 8,056,149, which is herein incorporated by reference.

TECHNICAL FIELD

The present invention pertains to a novel construction of a combination sock and shoe that is securely held to the foot of a wearer. In particular, the present invention pertains to a combination sock and shoe that includes a conventionally constructed athletic shoe sole, an exterior sock that is secured to the shoe sole, intermediate sock that is positioned inside the exterior sock, and an interior sock that is positioned inside the intermediate sock. The interior sock is constructed of substantially the same material as the exterior sock. The intermediate sock is constructed as an anklet having an elastic ankle opening. The exterior and interior socks conceal the intermediate sock from view by sandwiching the intermediate sock between them. When a wearer's foot is inserted into the combination sock and shoe, the elastic ankle opening of the intermediate sock securely engages around the ankle of the wearer's foot and holds the wearer's foot to the shoe sole, thereby preventing the shoe sole from separating away from the heel of the wearer's foot during walking.

BACKGROUND OF THE INVENTION

Casual shoes and slippers have been constructed that are combinations of a shoe sole and a sock. The prior art combination shoe and sock is basically constructed by securing the bottom surface of a sock to a top surface of a shoe sole. However, in the prior art combination shoe and sock construction, because the shoe sole is typically more rigid and less flexible than the material of the sock, when the wearer of the combined shoe and sock walks, the heel of the wearer's foot will often lift up from the shoe sole, causing the heel to move up into the portion of the sock that typically surrounds the wearer's ankle. This can result in the portion of the sock that now surrounds the wearer's heel to move between the wearer's heel and the top of the shoe sole, resulting in an annoying and uncomfortable feel to the wearer's foot as the wearer continues walking.

BRIEF SUMMARY OF THE INVENTION

The present invention overcomes the problems associated with the prior art combination shoe and sock by providing a novel construction of a combination sock and shoe that securely holds the shoe sole to the heel of a wearer's foot as the wearer walks wearing the combination sock and shoe. The combination sock and shoe of the invention is basically comprised of a shoe sole, an exterior sock that is secured to the shoe sole, an intermediate sock that is positioned inside the exterior sock and is provided with an elastic ankle opening, and an interior sock that is positioned inside the exterior sock and the intermediate sock and is constructed of the same material as the exterior sock.

The shoe sole of the combination sock and shoe is constructed of materials typically employed in constructing the soles of casual shoes such as slippers and athletic shoes. The shoe sole basically has a top surface, a bottom surface, and a sidewall that surrounds the shoe sole. The shoe sole bottom surface is the traction surface of the combination sock and shoe.

The exterior sock can be constructed of any fabric or material typically employed in constructing socks. The exterior sock is also constructed with the typical configuration of a sock. A bottom portion of the exterior sock is secured to the top surface of the shoe sole. A top portion or vamp portion of the exterior sock extends upwardly from and over the bottom portion of the exterior sock, defining a forward foot area of the sock and shoe combination. A heel portion of the exterior sock extends upwardly from the bottom portion and rearwardly from the top portion and defines a rearward foot area of the combination sock and shoe. An ankle portion of the exterior sock extends upwardly from both the vamp portion and heel portion and defines an ankle opening into the exterior sock.

The intermediate sock is positioned inside the exterior sock. The intermediate sock has the general configuration and construction of an anklet sock and is constructed of materials typically used in the construction of such socks. The intermediate sock includes a bottom portion that overlays the bottom portion of the exterior sock, a top portion that extends over the bottom portion of the intermediate sock and is positioned just below the top portion or vamp portion of the exterior sock, and a heel portion that is positioned just inside of the heel portion of the exterior sock and is connected to the top portion of the intermediate sock. A band having elastic property surrounds an ankle opening of the intermediate sock. The band can be stretched from a contracted shape to an expanded shape, where the ankle opening of the intermediate sock in the expanded shape is larger than the ankle opening in the contracted shape. The elastic properties of the band enable the intermediate sock ankle opening to return to the contracted ankle opening area after being stretched to the expanded ankle opening area.

The interior sock is positioned inside the exterior sock and inside the intermediate sock. The interior sock is constructed of the same material as the exterior sock and with the same configuration as the exterior sock. The insertion of the interior sock into the exterior sock and into the intermediate sock results in the intermediate sock being sandwiched between the interior sock and the exterior sock. Thus, the intermediate sock is concealed from view. In addition, the interior sock extending into the intermediate sock enables the wearer's foot to be easily inserted through the elastic band ankle opening of the intermediate sock and into the combination sock and shoe by inserting the wearer's foot into the combination sock and shoe in the same manner as inserting the foot into a conventional sock.

With the wearer's foot inserted into the combination sock and shoe, the elastic band of the intermediate sock securely engages around the ankle of the wearer's foot. This secures the combination sock and shoe to the wearer's foot. When walking with the combination sock and shoe on the wearer's foot, as the heel of the foot is lifted during a stride, the elastic band of the intermediate sock securely holds the shoe's sole adjacent the bottom of the wearer's heel and thereby prevents the disadvantage of prior art combination shoes and socks where the heel will lift away from the shoe sole during stride and the material of the sock that was surrounding the ankle then slides beneath the heel.

BRIEF DESCRIPTION OF THE SEVERAL VIEWS OF THE DRAWING

Further features of combination sock and shoe are set forth in the following detailed description of the invention and in the drawing figures.

DETAILED DESCRIPTION OF THE INVENTION

Figure 1:
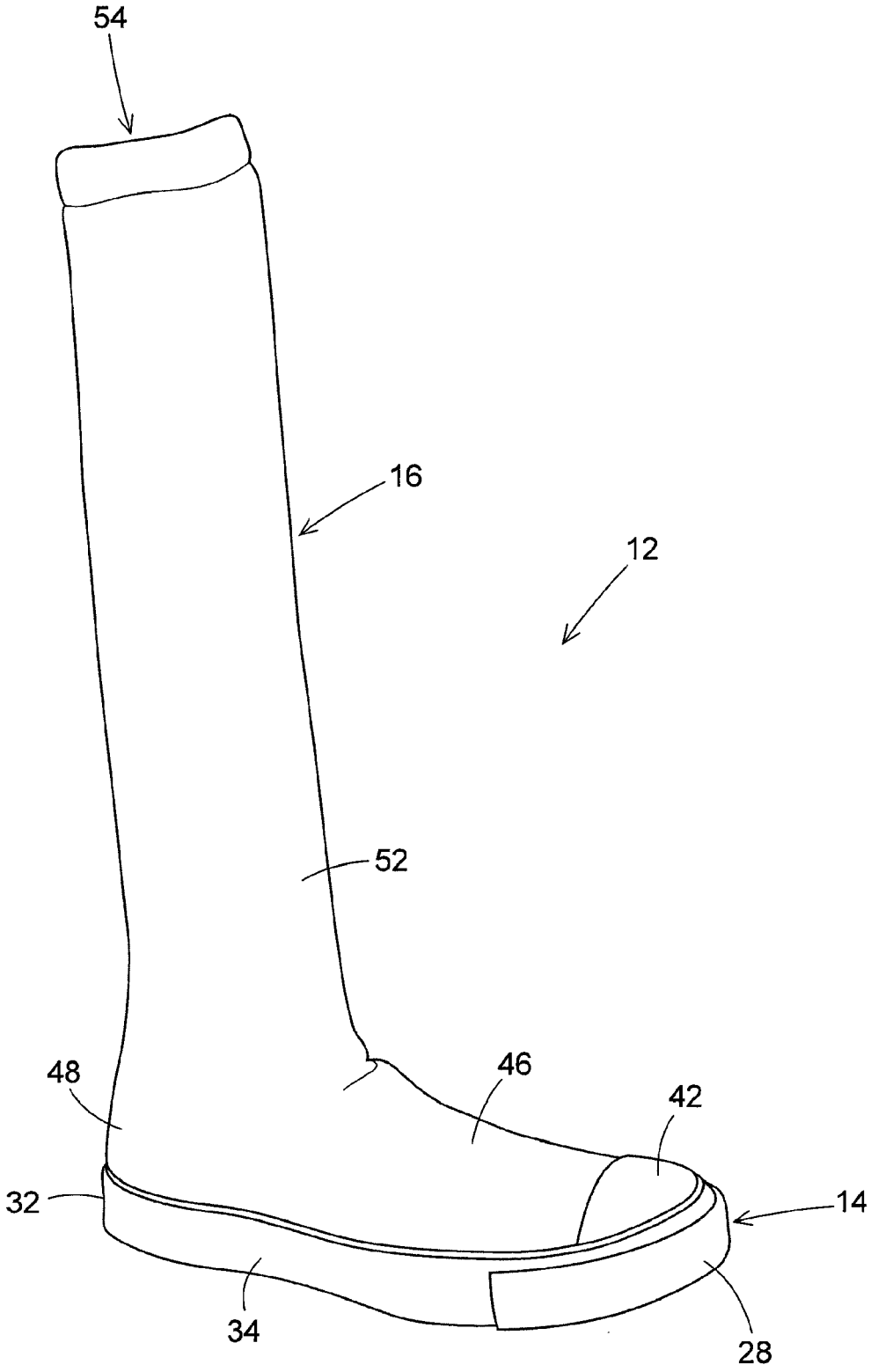
FIG. 1 is a side perspective view of the combination sock and shoe, in accordance with aspects of the present invention.

As stated earlier, the novel construction of the combination sock and shoe of the invention 12 shown in the drawing FIGS. 1-4 overcomes disadvantages associated with prior art shoe and sock constructions by securely holding the sole of the combination sock and shoe to the heel of a wearer's foot as the wearer walks wearing the combination sock and shoe. The construction of the combination sock and shoe 12 is basically comprised of a shoe sole 14, an exterior sock 16, an intermediate sock 18, and an interior sock 22.

The combination sock and shoe of the invention is described herein and is shown in the drawing figures by only referring to one of a left foot and right foot pair of the combination sock and shoe. Because the left and right foot pairs are mirror images of each other, only one combination sock and shoe of the invention is described herein.

The shoe sole 14 is constructed of materials typically employed in constructing the soles of casual shoes such as slippers and athletic shoes. In addition, the shoe sole 14 of the invention could have substantially the same constructions as other known casual shoes that provide comfortable support to the bottom of the wearer's foot. In view of this, the sole 14 of the combination sock and shoe 12 is shown only generally in the drawing figures, without specific details of the sole construction being shown or described herein. The sole 14 basically has a top surface 24 that supports the wearer's foot, and an opposite bottom surface 26 that functions as the traction surface of the combination sock and shoe 12. The sole 14 also has a sidewall that extends completely around the sole and separates the top surface 24 from the bottom surface 26. The sidewall has opposite toe 28 and heel 32 sections, and opposite side sections 32, 34 that together completely surround the shoe sole 14. In the cross-section view of FIGS. 2-3, it can be seen that an upper margin of the sole sidewall extends upwardly from the sole top surface 24.

In the illustrated embodiment of the combination sock and shoe 12 shown in the drawing figures, a toe cap 42 is provided over the toe area of the shoe sole 14. In other embodiments of the combination sock and shoe 12, the toe cap 42 could be eliminated.

The exterior sock 16 is secured to the top surface 24 of the shoe sole 14. Adhesives or other equivalent methods could be employed in securing the exterior sock 16 to the shoe sole 14. The exterior sock 16 is constructed of fabric or material typically employed in constructing socks. Such materials could have elastic properties that will securely hold the exterior sock 16 around the configuration of a wearer's foot and ankle. Furthermore, the exterior sock 16 shown in the drawing figures has an extended length that will extend well over the calf of a wearer's leg. This extended length of the exterior sock 16 is illustrative only, and the exterior sock of the combination sock and shoe of the invention could have a much shorter length.

Figure 2:
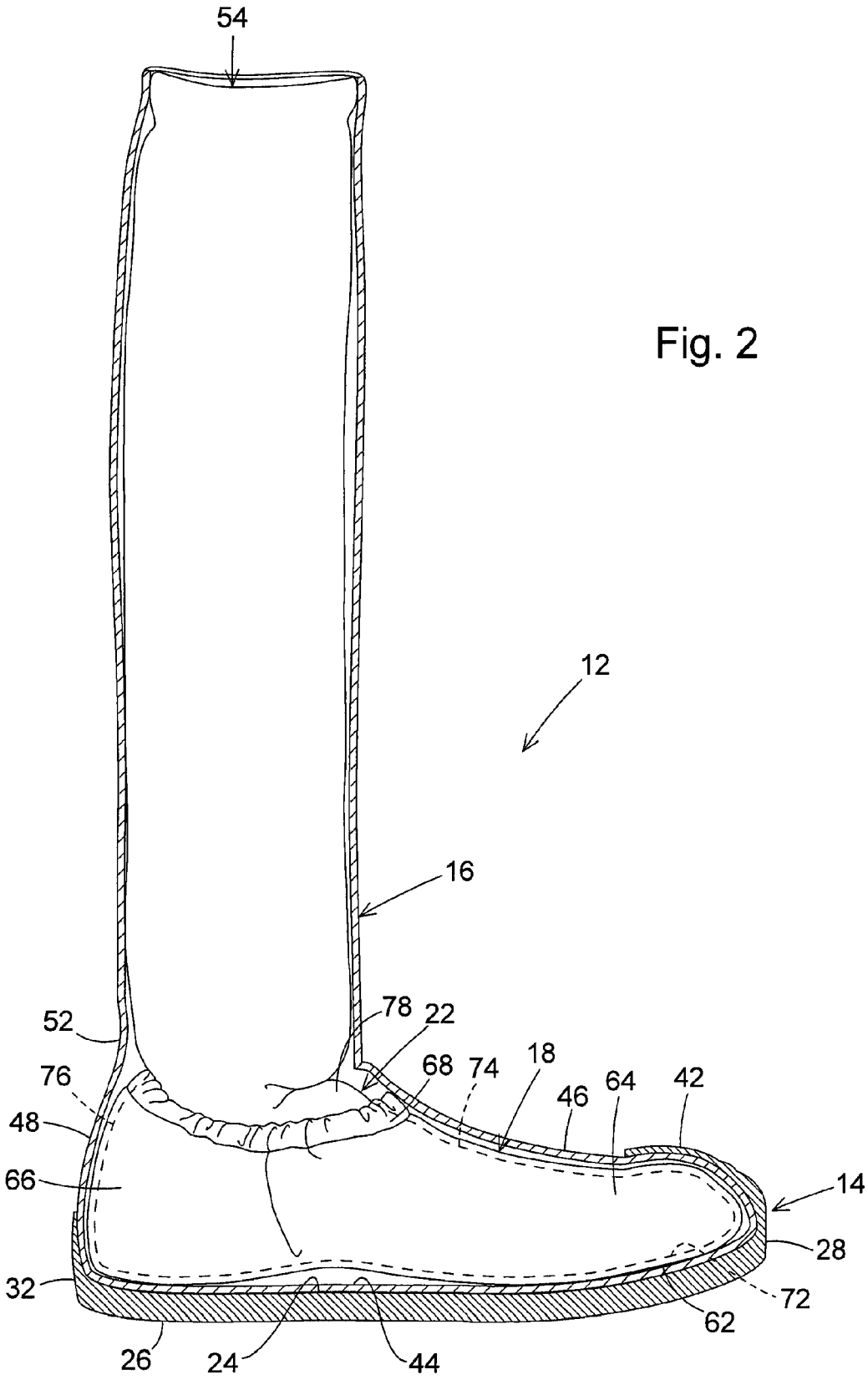
FIG. 2 is a side cross-section view of the combination sock and shoe, in accordance with aspects of the present invention.
Figure 3:
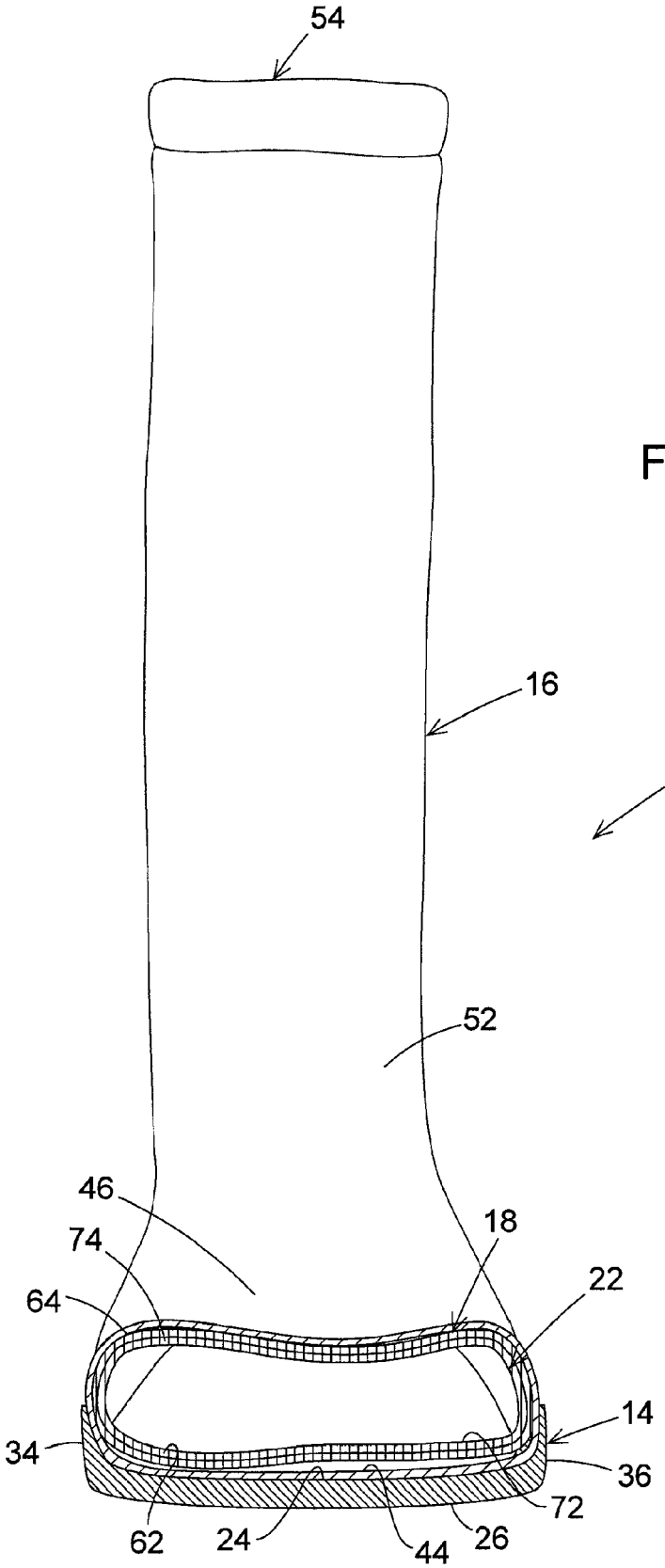
FIG. 3 is a front cross-section view of the combination sock and shoe, in accordance with aspects of the present invention.
Figure 4:
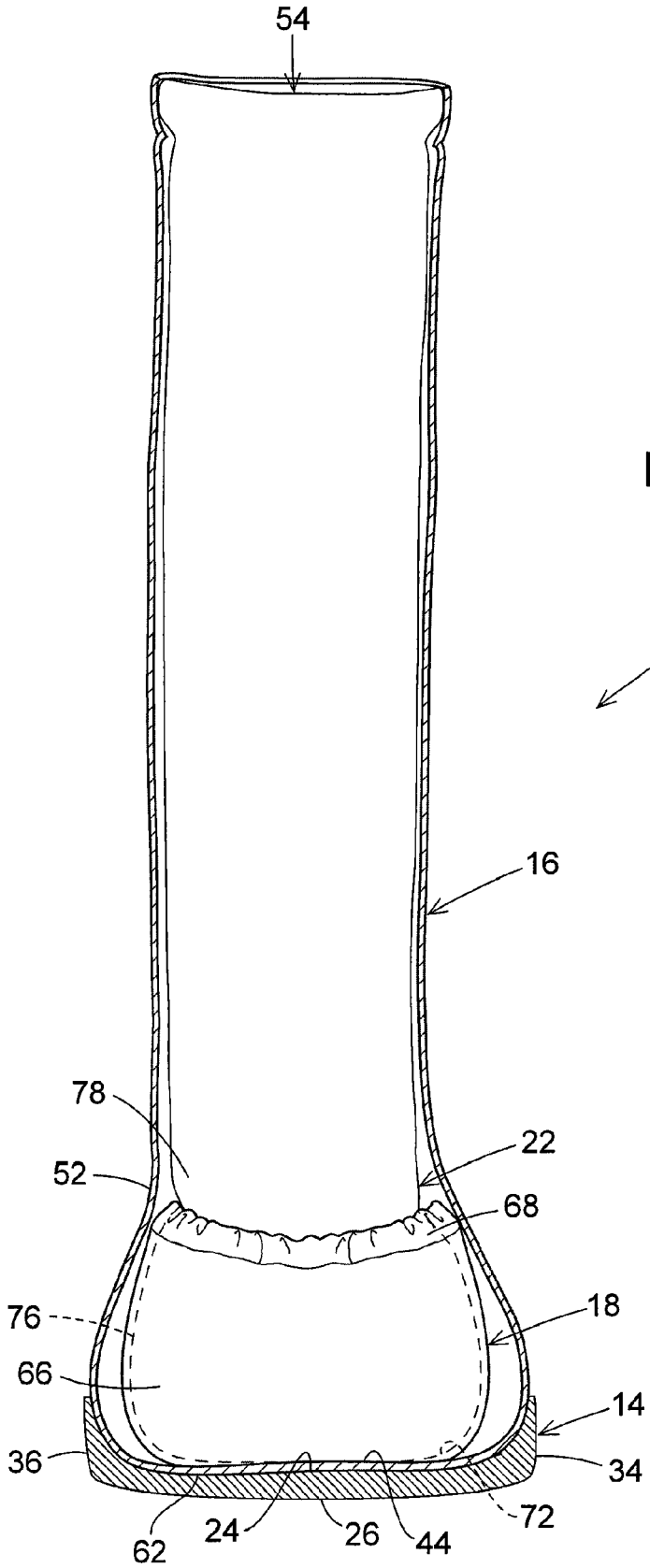
FIG. 4 is a rear cross-section view of the sock and shoe, in accordance with aspects of the present invention.

Referring to FIGS. 2-4, the exterior sock 16 has a bottom portion 44 that is secured to the top surface 24 of the shoe sole 14. This bottom portion 44 is basically dimensioned to underlie the bottom of a wearer's foot. The exterior sock 16 extends upwardly from the shoe sole 14 adjacent the sidewall of the shoe sole. A vamp portion 46 of the exterior sock extends upwardly from the bottom portion 44 from the toe section 28 of the sole sidewall and adjacent the side sections 34, 36 of the sole sidewall. The vamp portion 46 is dimensioned to cover over a forward portion of a wearer's foot.

A heel portion 48 of the exterior sock 16 also extends upwardly from the bottom portion 44. The heel portion 48 of the exterior sock extends upwardly along the heel section 32 of the shoe sole sidewall and along the side sections 34, 36 of the sidewall. The heel portion extends forwardly and joins with the vamp portion 46 of the exterior sock and is dimensioned to surround the heel of a wearer's foot.

An ankle portion 52 of the exterior sock 16 extends upwardly from the sock vamp portion 46 and heel portion 48. The embodiment of the combination sock and shoe 12 in the drawing figures comprises an exterior sock ankle portion 52 that extends upwardly a significant distance from the exterior sock vamp portion 46 and heel portion 48. In other embodiments of the invention, the length of the ankle portion 52 could be much shorter with the ankle portion 52 extending only around the ankle of a wearer's foot. The top of the exterior sock ankle portion 52 defines an ankle opening 54 into the combination sock and shoe 12.

In the embodiment of the combination sock and shoe 12 shown in the drawing figures, the upper portions of the shoe sole sidewall sections 28, 32, 34, 36 extend over the exterior sock 16. These upward extensions of the sidewall of the shoe sole 14 provide a secure connection between the shoe sole 14 and the exterior sock 16. In other embodiments of the combination sock and shoe, it is not necessary that the sidewall of the shoe sole 14 extend above the sole top surface 24. In such embodiments, only the bottom portion 44 of the exterior sock 16 is secured to the shoe sole top surface 24.

The intermediate sock 18 is secured inside the exterior sock 16. The intermediate sock 18 in the preferred embodiment shown has the general configuration and construction of an anklet sock. The material employed in constructing the intermediate sock 18 could be the same fabric or material employed in constructing the exterior sock 16, or could be a different fabric or material. The intermediate sock 18 has the same basic construction as the exterior sock 16, but the dimensions of the intermediate sock 18 are slightly smaller than those of the exterior sock 16. This allows the intermediate sock 18 to be positioned inside the exterior sock 16 and to engage in surface contact with the exterior sock 16 without being visibly present from outside of the exterior sock 16. The intermediate sock 18 has a bottom portion 62 that overlays and is secured to the exterior sock bottom portion 44. A vamp portion 64 of the intermediate sock 18 extends upwardly from the bottom portion 62 of the sock and is positioned just inside of and against the exterior sock vamp portion 46. The intermediate sock 18 also has a heel portion 66 that extends upwardly from the bottom portion 62 and is positioned just inside of and against the exterior sock heel portion 48. An ankle portion 68 of the intermediate sock 18 connects and extends upwardly from the vamp portion 64 and heel portion 66. The ankle portion 68 of the intermediate sock 18 is not secured to the exterior sock 16 and is free to move relative to the exterior sock 16. The ankle portion 68 of the interior sock has elastic properties that enable an ankle opening into the intermediate sock 18 to be stretched from a contracted ankle opening area to an expanded ankle opening area that is larger than the contracted ankle opening area. The elastic properties also enable the intermediate sock ankle opening to return to the contracted ankle opening area after being stretched to the expanded ankle opening area. These elastic properties of the ankle portion 68 of the intermediate sock 18 can be provided by constructing this portion of the sock from elastic materials. They could also be provided by an elastic band that extends around the ankle opening of the intermediate sock 18. Other equivalent means of contracting the ankle opening of the intermediate sock 18 could also be employed.

The interior sock 22 is positioned inside the exterior sock 16 and inside the intermediate sock 18. In the preferred embodiment of the invention, the interior sock 22 is constructed of the same materials as the exterior sock 16, thereby giving the visual impression that the interior sock 22 is actually the interior of the exterior sock 16. The intermediate sock 18 is concealed from view between the interior sock 22 and the exterior sock 16. The interior sock 22 is also constructed with slightly smaller dimensions than the exterior sock 16 and the intermediate sock 18 to enable its positioning in the exterior sock and interior sock. Thus, the interior sock 22 has a bottom portion 72 that overlays both the intermediate sock bottom portion 62 and the exterior sock bottom portion 44. The sock also has a vamp portion 74 that extends upwardly from the bottom portion 72 just inside of the intermediate sock vamp portion 64 and the exterior sock vamp portion 46. The intermediate sock 22 also has a heel portion 76 that extends upwardly from the bottom portion 72 just inside of the intermediate sock heel portion 66 and the exterior sock heel portion 48. An ankle portion 78 of the interior sock 22 extends upwardly from the vamp portion 74 and the heel portion 76 of the sock, through the ankle opening defined by the ankle portion 68 of the intermediate sock 18, and upwardly through the interior of the exterior sock ankle portion 52. Thus, the interior sock 22 and exterior sock 16 sandwich the intermediate sock 18 between them, and thereby conceal the intermediate sock from view. In addition, the interior sock 22 extending into the intermediate sock 18 and the exterior sock 16 enables the wearer's foot to be easily inserted through the elastic ankle opening 68 of the intermediate sock 18 and into the combination sock and shoe 12 by inserting the wearer's foot into the interior sock 22 in the same manner as inserting the foot into a conventional sock.

With the wearer's foot inserted into the combination sock and shoe 12, the elastic properties of the intermediate sock ankle portion 68 securely engage the ankle portion 68 around the ankle of the wearer's foot. This secures the combination sock and shoe 12 to the wearer's foot. When walking with the combination sock and shoe on the wearer's foot, as the heel of the foot is lifted from the sole 14 during a stride, the elastic properties of the intermediate sock ankle portion 68 securely hold the shoe sole 14 adjacent the bottom of the wearer's heel and thereby prevents the disadvantage of prior art combination shoes and socks where the heel will lift away from the shoe sole during a stride and the material of the sock that was surrounding the ankle then slides beneath the heel.

Although the combination sock and shoe of the invention has been described above by referring to a particular embodiment, it should be understood that modifications and variations could be made to the combination sock and shoe without departing from the intended scope of the following claims.

Having thus described the invention, what is claimed is:

1. A combination sock and shoe comprising:

a shoe sole having opposite top and bottom surfaces;

an exterior sock secured to the shoe sole, the exterior sock having an upper opening;

an intermediate sock separate from the exterior sock and positioned inside the exterior sock, the intermediate sock being secured to the exterior sock and thereby being secured to the shoe sole, and the intermediate sock having an ankle portion with an elastic ankle opening, wherein the ankle portion of the intermediate sock is not secured to the exterior sock; and an interior sock positioned inside the exterior sock and also positioned inside the intermediate sock, the interior sock having an ankle opening such that the exterior sock upper opening and the interior sock ankle opening extend upwardly from the shoe sole top surface farther than the intermediate sock ankle opening extends.

2. The combination sock and shoe of claim 1, further comprising:

the exterior sock completely covering over the intermediate sock and concealing the intermediate sock from view from a perspective outside the exterior sock.

3. The combination sock and shoe of claim 2, further comprising:

the exterior sock having a bottom portion that overlays and is secured to the top surface of the shoe sole; and, the intermediate sock having a bottom portion that overlays and is secured to the exterior sock bottom portion.

4. The combination sock and shoe of claim 2, further comprising:

the exterior sock being constructed of a continuous material that completely surrounds a wearer's foot; and, the intermediate sock being constructed of a continuous material that completely surrounds a wearer's foot.

5. The combination sock and shoe of claim 2, further comprising:

the exterior sock being constructed of a woven material.

6. A combination sock and shoe comprising:

a shoe sole having opposite top and bottom surfaces;

an exterior sock secured to the shoe sole top surface and extending upwardly from the shoe sole to a first opening;

an intermediate sock inside the exterior sock and secured to the exterior sock, the intermediate sock having an ankle opening and an ankle portion, wherein the ankle portion of the intermediate sock and the ankle opening are unsecured to the exterior sock; and, an interior sock inside the exterior sock and inside the intermediate sock, the intermediate sock being sandwiched between the exterior sock and the interior sock, an interior sock ankle portion extending upwardly through the intermediate sock ankle opening.

7. The combination sock and shoe of claim 6, further comprising:

the exterior sock and the interior sock both extending upwardly from the shoe sole beyond the intermediate sock ankle portion.

8. The combination sock and shoe of claim 6, further comprising:

an exterior sock ankle portion being separate from and not secured to the intermediate sock ankle portion.

9. The combination sock and shoe of claim 6, further comprising:

the exterior sock and the interior sock being constructed of a same material.

10. The combination sock and shoe of claim 6, further comprising:

the exterior sock having a bottom portion that overlays and is secured to the top surface of the shoe sole;

the intermediate sock having a bottom portion that overlays and is secured to the exterior sock bottom portion and is thereby secured to the shoe sole; and, the interior sock having a bottom portion that overlays the intermediate sock bottom portion.

11. The combination sock and shoe of claim 6, further comprising:

the exterior sock ankle opening and an interior sock ankle opening being coextensive ankle openings.

12. The combination sock and shoe of claim 11, further comprising:

the ankle portions of the exterior sock and the interior sock extending upwardly from the shoe sole beyond the ankle portion of the intermediate sock.

13. The combination sock and shoe of claim 6, further comprising:

the exterior sock being constructed of a continuous material that completely surrounds a wearer's foot;

the intermediate sock being constructed of a continuous material that completely surrounds a wearer's foot; and, the interior sock being constructed of a continuous material that completely surrounds a wearer's foot.

14. The combination sock and shoe of claim 6, further comprising:

the exterior sock and the interior sock being constructed of a same woven material.

15. A combination sock and shoe comprising:

a shoe sole having opposite top and bottom surfaces;

an exterior sock, the exterior sock having a bottom portion secured to the shoe sole top surface, the exterior sock extending upwardly from the shoe sole to a first opening;

an intermediate sock inside the exterior sock, the intermediate sock having a bottom portion secured proximate to the exterior sock bottom portion, the intermediate sock having an ankle opening and an ankle portion, wherein the ankle portion and the ankle opening of the intermediate sock are unsecured to the exterior sock; and, an interior sock inside the exterior sock and inside the intermediate sock such that an exterior surface of the intermediate sock is proximate the exterior sock and an interior surface of the intermediate sock is proximate the interior sock, an interior sock ankle portion extending upwardly beyond the intermediate sock ankle opening.

* * * * *